US010271577B2

(12) United States Patent
Hoover et al.

(10) Patent No.: US 10,271,577 B2
(45) Date of Patent: Apr. 30, 2019

(54) WATER PIPE STABILIZER

(71) Applicants: Jason Hoover, Martinez, CA (US); Jennifer Hoover, Martinez, CA (US)

(72) Inventors: Jason Hoover, Martinez, CA (US); Jennifer Hoover, Martinez, CA (US)

( * ) Notice: Subject to any disclaimer, the term of this patent is extended or adjusted under 35 U.S.C. 154(b) by 744 days.

(21) Appl. No.: 14/588,016

(22) Filed: Dec. 31, 2014

(65) Prior Publication Data

US 2015/0181931 A1 Jul. 2, 2015

Related U.S. Application Data

(60) Provisional application No. 61/922,970, filed on Jan. 2, 2014.

(51) Int. Cl.
*A24F 9/14* (2006.01)
*A24F 1/30* (2006.01)

(52) U.S. Cl.
CPC . *A24F 9/14* (2013.01); *A24F 1/30* (2013.01)

(58) Field of Classification Search
CPC ..... A24F 9/14; A24F 1/30
USPC ..... 131/240.1
See application file for complete search history.

(56) References Cited

PUBLICATIONS

Screen captures from YouTube video clip entitled "How to Put the Binger Clinger on/ close up," 4 pages, uploaded on May 23, 2013 by user "Binger Clinger". Retrieved from Internet: <https://www.youtube.com/watch?v=YhUhaC6WnM4>. (Year: 2013).*
Beaker Protector Skin [online]. Smoketower, Nov. 27, 2013 [retrieved on Mar. 16, 2018]. Retrieved from the Internet: <URL: https://web.archive.org/web/20131127123521/https://www.smoketower.ca/store/beaker-protector-skin.html>. (Year: 2013).*
Large Base Protector [online]. 5StarHookah, Oct. 11, 2011 [retrieved on Mar. 16, 2018]. Retrieved from the Internet: <URL: https://web.archive.org/web/20111011094432/http://5starhookah.com/Large-Base-Protector-7856.htm>. (Year: 2011).*

* cited by examiner

*Primary Examiner* — Michael H. Wilson
*Assistant Examiner* — Yana B Krinker
(74) *Attorney, Agent, or Firm* — Pastore Law; Brian D. Pastore, Esq.

(57) ABSTRACT

A stabilizer for water pipes used for smoking substances, comprising a wrap configured to hold in a portion of the water pipe and a support that is wider than the base floor of the water pipe. The stabilizer can provide a wider and more stable base for the water pipe that can counteract and/or prevent tipping of the water pipe, and/or can provide shock absorption properties to reduce the risk of a water pipe tipping over and breaking or spilling.

12 Claims, 11 Drawing Sheets

WATER PIPE STABILIZER

CLAIM OF PRIORITY

This application claims priority under 35 U.S.C. § 119(e) from earlier filed U.S. Provisional Application Ser. No. 61/922,970, filed Jan. 2, 2014, which is hereby incorporated by reference.

BACKGROUND

Field of the Invention

The present disclosure relates to water pipes used for smoking, particularly a stabilizer that assists in preventing water pipes from tipping over.

Background

Water pipes are often used to smoke tobacco, herbal substances, and other smokable substances. FIGS. 1A-1C depict exemplary embodiments of water pipes 100. A water pipe 100 can comprise a base chamber 102, a stem 104, a bowl 106, a tubular extension 108, and/or a carburetor 110.

The base chamber 102 can be a hollow chamber with a closed base and/or sides, such that the base chamber 102 can hold a quantity of water or other liquid. The base chamber 102 can have a substantially flat floor 112 such that the water pipe 100 can rest on a surface. In some embodiments, the base chamber 102 can have a protrusion and/or opening configured to accept a stem 104. In some embodiments, the base chamber 102 can be substantially conical with sides tapering upward from a floor 112, as shown in FIG. 1A. In other embodiments, the base chamber 102 can be substantially spherical with a floor 112, as shown in FIG. 1B. In yet other embodiments, the base chamber 102 can be a tube with substantially the same diameter as the tubular extension 108, with a flanged floor 112 extending out of a bottom portion of the base chamber 102, as shown in FIG. 1C. In still other embodiments, the base chamber 102 can have any other desired shape.

The stem 104 can connect the bowl 106 to the base chamber 102. In some embodiments, the stem 104 can extend through an opening or protrusion in the base chamber 102 at least partially into the center of the base chamber 102. The bowl 106 can be a chamber or receptacle that can be filled with tobacco or any other smokable substance. The stem 104 can be hollow, such that smoke created when a smokable substance within the bowl 106 is lit can be drawn through the stem 104 into the base chamber 102 and/or into water within the base chamber 102. In some embodiments the stem 104 and bowl 106 can be integral with the rest of the water pipe 100, while in other embodiments the stem 104 and/or bowl 106 can be removable.

The tubular extension 108 can extend from the base chamber 102 in an at least partially vertical orientation relative to the floor 112 of the base chamber 102. The tubular extension can be hollow, such that smoke can rise through the tubular extension 108 out of the base chamber 102. The tubular extension 108 can define a mouth opening 114 at its upper tip, such that smoke can escape the water pipe 100 through the mouth opening 114 after being drawn through the stem 104 from the bowl 106, through water in the base chamber 102, and up through the tubular extension 108. In some embodiments the tubular extension 108 can be straight, while in other embodiments the tubular extension 108 can be curved, bent, or have any other shape.

The carburetor 110 can be an opening in the water pipe 100 that can be selectively sealed to block the carburetor 110 or opened to allow air into the interior of the water pipe 100.

In some embodiments, the carburetor 110 can be an opening in the base chamber 102 that can be sealed when a removable stem 104 and/or bowl 106 is inserted into the base chamber 102, or opened when the removable stem 104 and/or bowl 106 is removed, as shown in FIGS. 1A and 1C, such that air can pass down the stem 104 when the bowl 106 is removed. By way of a non-limiting example, the bowl 106 can be removed In other embodiments, the carburetor 110 can be a hole in the side of the base chamber 102 and/or tubular extension 108 that can be selectively closed by a user, as shown in FIG. 1B. By way of a non-limiting example, a user can plug or unplug the carburetor hole using a finger or other plug.

In some embodiments, a water pipe 100 can be made of glass. In other embodiments, a water pipe 100 can be made of plastic, metal, ceramics, bamboo and/or any other material. The shapes, sizes, and designs of the components of a water pipe 100 can vary significantly between different embodiments. By way of a non-limiting example, different water pipes 100 can be different colors, have different exterior designs or artistic components, contain one or more bases and/or chambers, tubing, or other components, and/or have unique or varying shapes.

As can be seen from FIGS. 1A-1C, many water pipes 100 are much taller than they are wide. In addition, many water pipes 100 have an imbalanced weight distribution because the stem 104 and bowl 106 are positioned on only one side of the water pipe 100 without any counterbalance. Water pipes 100 are therefore often prone to easily tipping over due to these imbalanced dimensions and weight distributions. Because water used in the smoking process can often be dirty and/or odorous, accidental spillage of such water when a water pipe 100 tips over can lead to unpleasant clean up and/or stains. Additionally, water pipes 100 often break when they tip over, leading to the need to replace the water pipe 100 and/or safety hazards due to shards of broken glass or other material.

As water pipes 100 can be unique, have sentimental value, and/or be expensive to replace, many users desire to protect their water pipes 100 and prevent them from tipping over. Some users attach a detachable base stand to the floor 112 of their existing water pipe 100, but conventional detachable base stands are often customized to a particular shape and size of base chamber 102 and are therefore not universal to many different water pipe designs, and they often do not provide a base with sufficient weight, width, or stabilizing properties to effectively prevent water pipes 100 from tipping over. Other users place an existing water pipe 100 into a stand that is similar to a guitar stand when the water pipe 100 is not in use, but these stands are generally used only for storage and do not help prevent tipping when the water pipe 100 is in use. Finally, other users attach rubber o-rings around various portions of an existing water pipe 100, such as around the tubular extension 108, to provide padding and/or shock absorption if the water pipe 100 tips over, but these o-rings do not help prevent tips from occurring in the first place.

What is needed is a universal stabilizer that can be used with a variety of different designs of water pipes 100, as the shapes and sizes of the components of a water pipe 100 can vary significantly between different embodiments. The universal stabilizer should be configured to hold water pipes 100 of a variety of different shapes and sizes, and to provide a stable base that can help correct the water pipe's orientation into a proper standing position if it is set down at an angle, begins to tip, or is in the process of tipping.

DETAILED DESCRIPTION

Figure 1A:
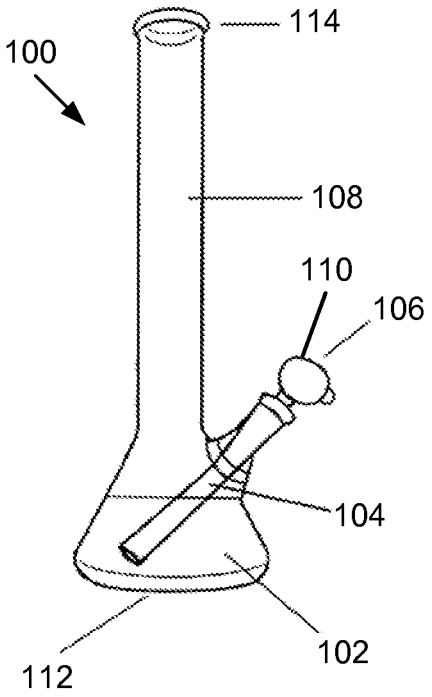
FIG. 1A depicts a first embodiment of a prior art water pipe.
Figure 1B:
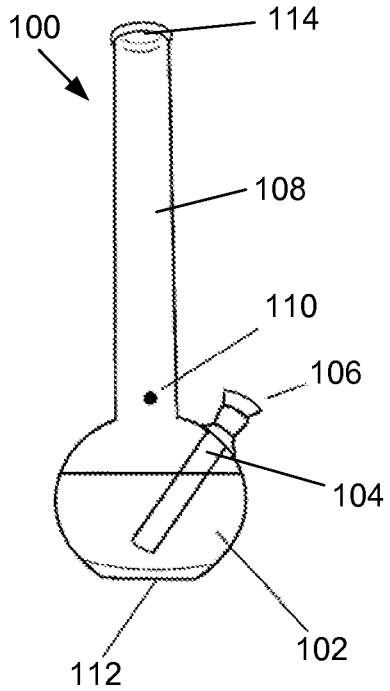
FIG. 1B depicts a second embodiment of a prior art water pipe.
Figure 1C:
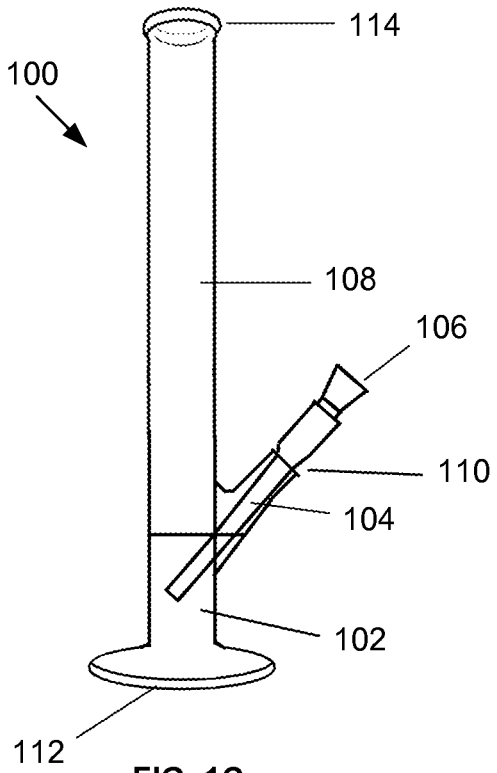
FIG. 1C depicts a third embodiment of a prior art water pipe.
Figure 2:
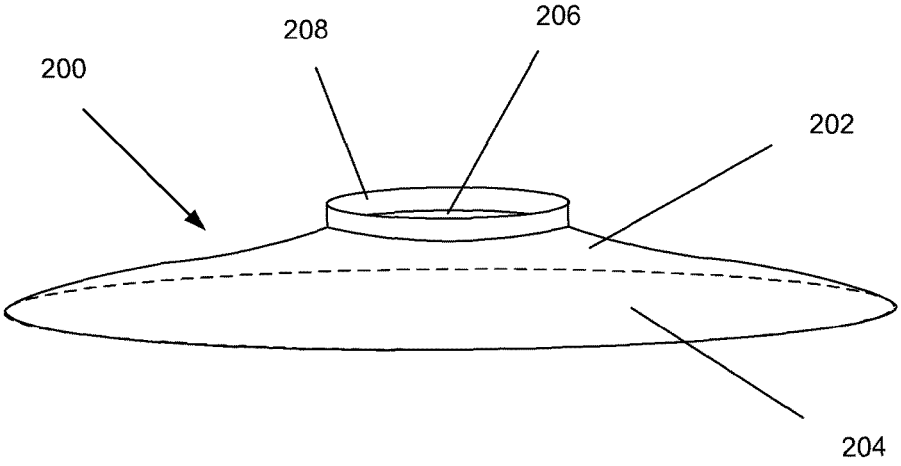
FIG. 2 depicts an exemplary embodiment of a stabilizer comprising elastomeric material.

FIG. 2 depicts an exemplary embodiment of a stabilizer 200. A stabilizer 200 can comprise a wrap 202 and a support 204. The wrap 202 can be configured to at least partially surround and hold in a portion of a water pipe 100, such as the base chamber 102. The support 204 can be a member that provides shape and/or structure to the bottom of the wrap 202.

In some embodiments, such as the exemplary embodiment shown in FIG. 2, the wrap 202 can comprise stretchable elastomeric material that naturally tends to retract from a stretched state towards a contracted state. The stretchable elastomeric material can be configured to be formed or molded around portions of a water pipe 100. By way of non-limiting examples, the wrap 202 can comprise rubber, latex, silicone, elastic, neoprene, spandex, and/or any other stretchable elastomeric material. In some embodiments, the wrap's material can further be at least partially clingy or sticky, such that the wrap 202 can cling to the exterior of an inserted water pipe 100.

In these embodiments, the wrap 202 can define at least one opening 206. In some embodiments, an opening 206 can be defined by and/or be reinforced by extruded or raised edges 208. In other embodiments the edges 208 of an opening 206 can be flush with surrounding portions of the wrap 202.

In embodiments with a stretchable wrap 202, the dimensions and size of a wrap 202 and its openings 206 can be changed by a user by stretching the wrap 202. By way of a non-limiting example, an upper opening 206*a* can be expanded to fit around the base chamber 102 of a water pipe 100 such that the base chamber 102 can be inserted into the wrap 202. The stretchable wrap 202 can be positioned to at least partially surround, contract around, and/or cling to the exterior of the base chamber 102 and/or other components of the water pipe 100. Because the wrap 202 can be stretched, it can be stretched to fit around, cling to, and/or hold in a variety of different shapes and sizes of water pipes 100. By way of a non-limiting example, a latex or silicone wrap 202 can be stretched and molded around portions of a base chamber 102, and the latex or silicone material can cling to the exterior of the base chamber 102 to secure the wrap 202 around the water pipe 100.

Figure 3A:
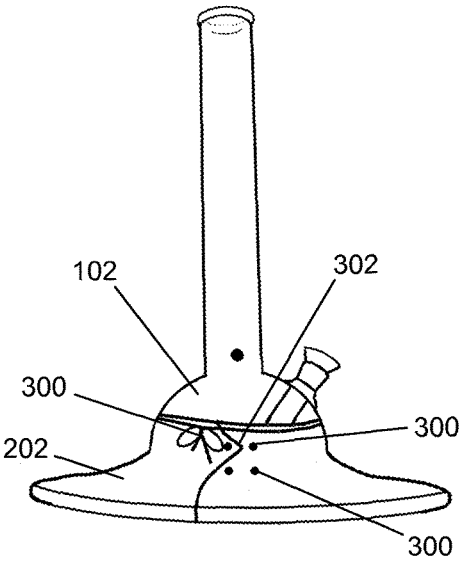
FIG. 3A depicts an exemplary embodiment of a stabilizer comprising flexible material wrapped around a spherical base chamber of a water pipe.
Figure 3B:
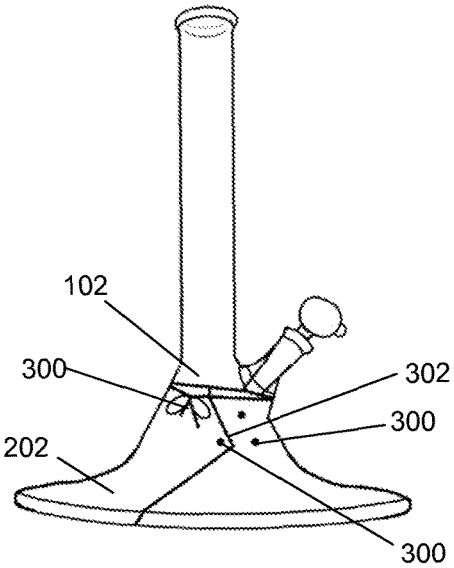
FIG. 3B depicts an exemplary embodiment of a stabilizer comprising flexible material wrapped around a conical base chamber of a water pipe.

In alternate embodiments, such as the embodiment shown in FIGS. 3A-3B, the wrap 202 can comprise flexible material such as fabric, leather, canvas, mesh, nylon, or any other flexible material. In these embodiments, the wrap 202 can be shaped with flaps, folds, and/or be loose enough such that it can be grouped, wrapped, or folded around at least a portion of a water pipe 100, such as a portion of its base chamber 102. In these embodiments, the wrap 202 can comprise a plurality of connectors 300 that can be mated, joined, and/or tied to secure the wrap 202 around the water pipe 100. The connectors 300 can be hook and loop fasteners, snaps, clips, zippers, belts, straps, string ties, and/or any other type of connector. To accommodate various different shapes and sizes of water pipes 100 and base chambers 102, some embodiments can have a plurality of connectors 300 placed at multiple positions on the wrap 202 such that a user can select an appropriate pair of connectors 300 to mate in order to secure the wrap 202 around the particular size and shape of the water pipe 100 being used with the stabilizer 200. By way of a non-limiting example, FIGS. 3A and 3B depict an embodiment in which a wrap 202 has multiple snaps, and a snap on a corner flap 302 of the wrap 202 can be mated with a different corresponding snap depending on whether the wrap 202 is being secured around a spherical or a conical base chamber 102. In this example, because the conical base chamber 102 has less bulk near its top than the spherical base chamber 102, the corner flap 302 can reach farther around the conical base chamber 102 and be connected to the lower left snap, whereas the corner flap 302 can be connected to the upper left snap around the spherical base chamber 102. Additionally, FIGS. 3A and 3B show that the wrap 202 can have a string tie that can be wrapped around the exterior of the water pipe 100 to secure the wrap 202 around the water pipe 100.

Figure 4:
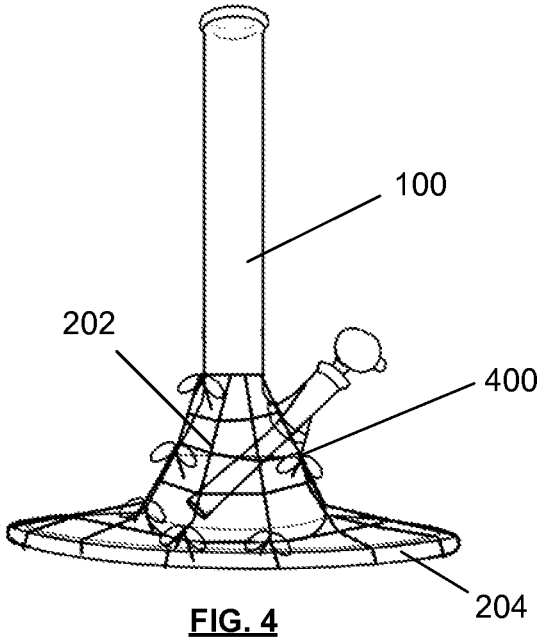
FIG. 4 depicts an exemplary embodiment of a stabilizer comprising netting.

FIG. 4 depicts an alternate embodiment in which the wrap 202 is a net that can be wrapped around and secured to portions of a water pipe 100. In some embodiments, the net can have drawstrings 400 that can be tightened and tied together around the water pipe 100 to secure the wrap 202 around the water pipe 100. In other embodiments, the net can have elastomeric cords that can be stretched when inserting a water pipe 100 and then relaxed to contract the wrap 202 around the water pipe 100.

Figure 5:
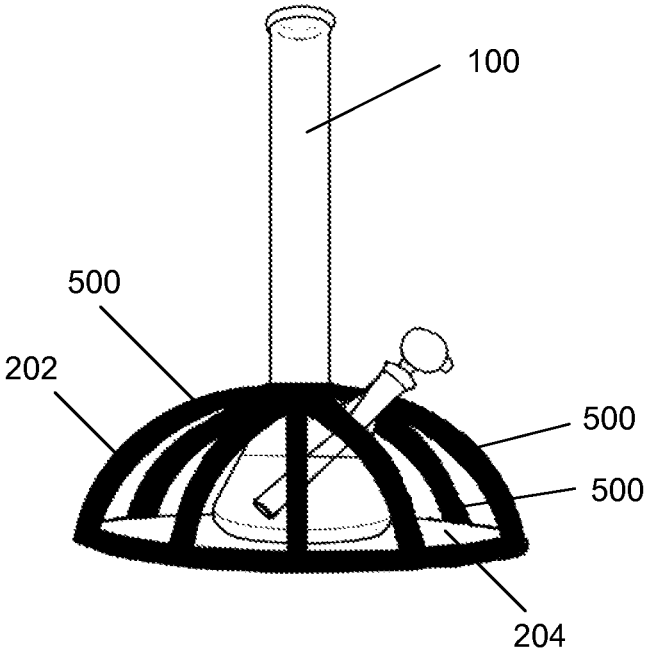
FIG. 5 depicts an exemplary embodiment of a stabilizer comprising a cage.

FIG. 5 depicts an alternate embodiment in which the wrap 202 is a cage comprising a plurality of arms 500 extending upward from the support 204. The arms 500 can be curved or bent inward toward a central convergence point as they extend upward from the support 204. In these embodiments, a water pipe's base chamber 102 can be inserted into the cage such that the arms 500 can extend around the base chamber 102. The ends and/or interior edges of the arms 500 can press into the sides of the water pipe 100 to hold in the water pipe 100. By way of a non-limiting example, FIG. 5 shows that the ends of the arms 500 can converge around and press into the tubular extension 108. In some embodiments, the arms 500 can be rigid, and can be coupled with the support member using lockable hinges such that the hinges can be unlocked to rotate the rigid arms 500 away from the center of the stabilizer 200 and allow insertion of a base chamber 102. In other embodiments, the arms 500 can be at least partially flexible such that the arms 500 can be flexed to allow insertion of a base chamber 102 into the center of the cage.

Figure 6:
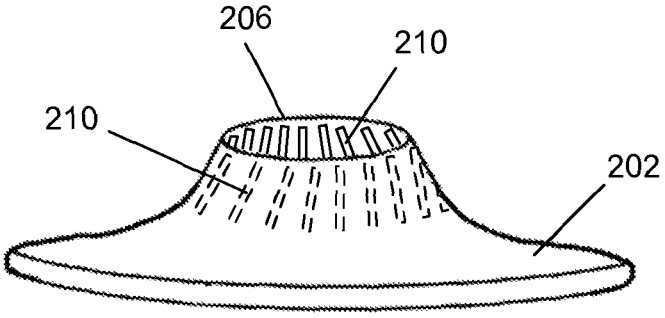
FIG. 6 depicts an exemplary embodiment of a stabilizer with internal textured components.

In some embodiments, one or more surfaces of the wrap 202 that are designed to contact the water pipe 100 can have textured components 210 such that friction between the water pipe 100 and the textured components 210 can assists in preventing the water pipe 100 from moving relative to the wrap 202 secured around it. By way of a non-limiting example, FIG. 6 depicts an embodiment in which rubberized treads are positioned on the interior surfaces of the wrap 202 proximate to the opening 206. In other embodiments, the textured components 210 can be absent, and/or the material of the wrap 202 can provide such friction when the wrap 202 is secured around a water pipe 100.

Figure 7:
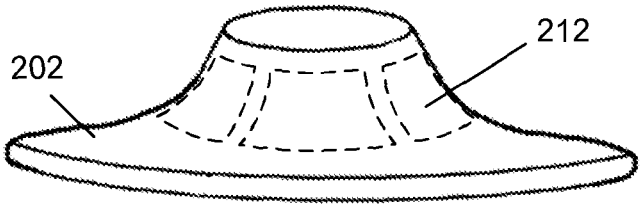
FIG. 7 depicts an exemplary embodiment of a stabilizer with padded pockets.

In some embodiments, the wrap 202 can be inherently cushioned. By way of a non-limiting example, a wrap 202 comprising rubber or other compressible material can provide cushioning and/or shock absorption to a water pipe 100 secured within the wrap 202. In other embodiments, the wrap 202 can have one or more cushioning components 212, such as pockets filled with air, gel, foam, cotton, or any other padding material, as shown in FIG. 7.

Figure 8:
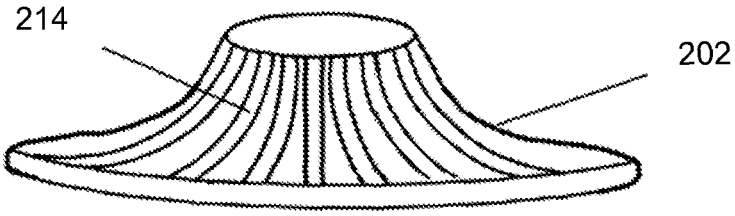
FIG. 8 depicts an exemplary embodiment of a stabilizer with ribs.

In some embodiments, the wrap 202 can further comprise a plurality of ribs 214 interspersed throughout the wrap 202 in a parallel configuration, interlocking configuration, or any other configuration, as shown in FIG. 8. The ribs 214 can be at least semi-rigid to assist in holding up the top of the flexible material that comprises the wrap 202. By way of a non-limiting example, the ribs 214 can assist in holding up the edges 208 of the opening 206. The ribs 214 can also assist in holding in portions of a water pipe 100 when the wrap 202 is secured around the water pipe 100. In other embodiments the ribs 214 can be absent.

Figure 9A:
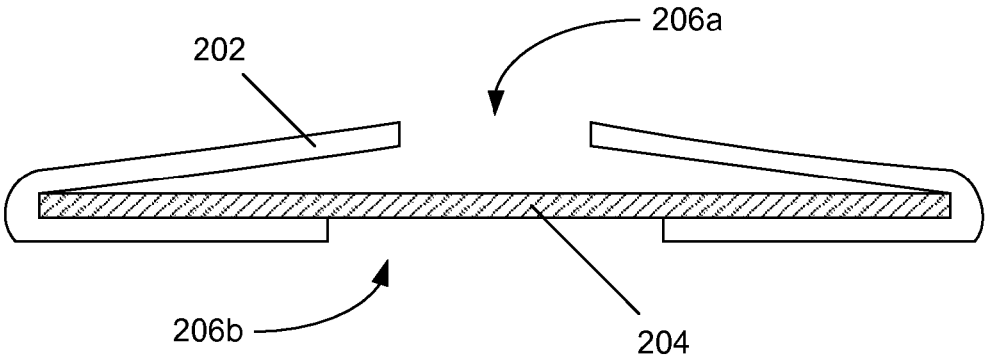
FIG. 9A depicts an exemplary embodiment of a stabilizer in which a wrap partially extends underneath a support and has a lower opening.
Figure 9B:
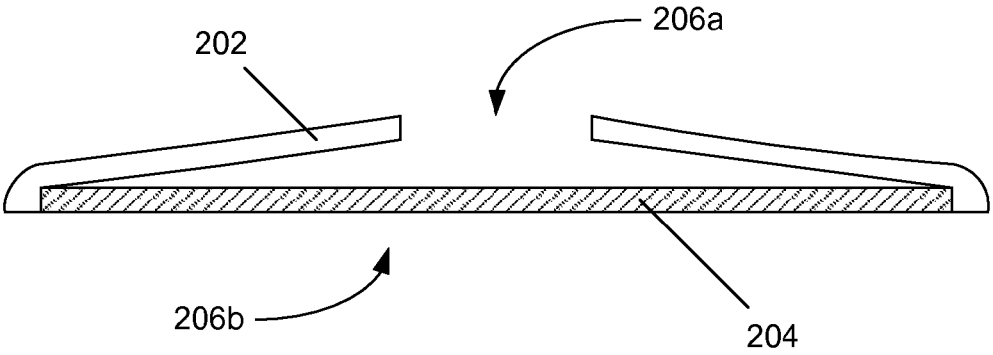
FIG. 9B depicts an exemplary embodiment of a stabilizer in which a wrap is coupled with the perimeter edges of a support and has a lower opening.

In some embodiments, a wrap 202 can define an upper opening **206*a* and a lower opening 206*b*, as shown in the cross sections of FIGS. 9A and 9B. In other embodiments, a wrap 202 can define an upper opening 206*a* and have a closed bottom surface, as shown in the cross section of FIG. 9**C.

The support 204 can comprise one or more components that are coupled with the wrap 202 and/or are housed within the wrap 202. In some embodiments the support 204 can be a round, substantially planar disc. In other embodiments, the support can be rectangular, triangular, ovoid, or polygonal, have extensions, or have any other desired shape. In some embodiments, the support 204 can have dimensions larger than the dimensions of the floors 112 of most water pipes 100. In other embodiments, the support 204 can have dimensions substantially equal to or smaller than the dimensions of the floor 112 of a water pipe 100. In some embodiments the dimensions of the support 204 can be fixed, while in other embodiments the dimensions of the support 204 can be adjustable. In some embodiments, the perimeter edges of the support 204 can be beveled or rounded to assist in smoothly inserting the support 204 into the wrap 202.

Figure 10A:
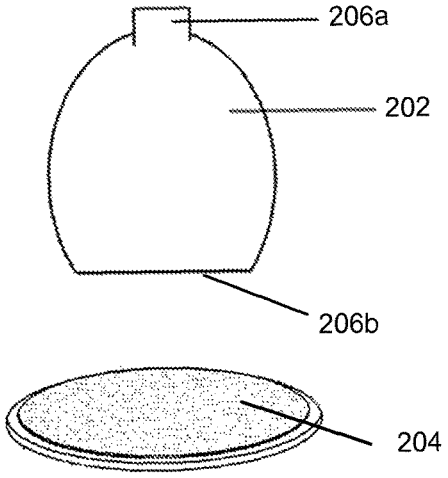
FIGS. 10A-10D depict exemplary steps for assembling one embodiment of a stabilizer.
Figure 10B:
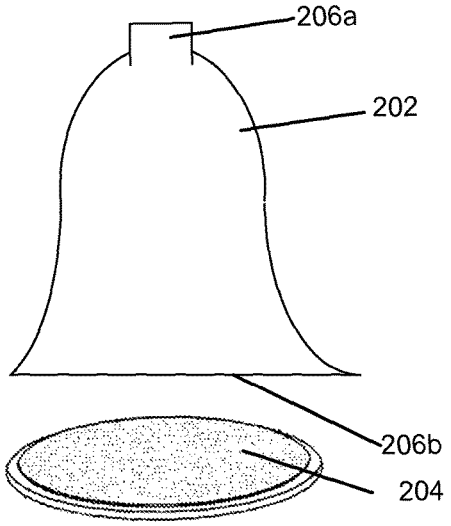
Figure 10C:
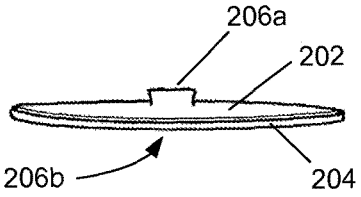
Figure 10D:
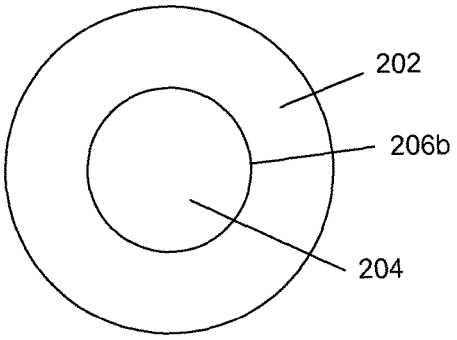

The presence of the support 204 can push and/or pull the sides of the material of the wrap 202 outward to fit around the dimensions of the support 204. As discussed above, in some embodiments the wrap 202 can have a lower opening **206*b*. In some embodiments with a lower opening 206*b*, the wrap 202 can be stretched or manufactured such that the wrap 202 extends around and partially underneath the support 204, such that the lower opening 206*b* is underneath the support 204, as shown in FIG. 9A. In other embodiments with a lower opening 206*b*, the wrap 202 can be stretched or manufactured such that the edges of the lower opening 206*b* are coupled with the sides of the support 204, as shown in FIG. 9B. By way of a non-limiting example, FIGS. 10A-10B depict assembly of an embodiment of the stabilizer 200 with a stretchable wrap 202 having a lower opening 206*b*. As seen in FIG. 10A, the support 204 can be wider than the wrap 202. As seen in FIG. 10B, the lower opening 206*b* of the wrap 202 can be stretched such that the support 204 can be inserted into the wrap 202 through the stretched lower opening 206*b*. As seen in FIG. 10C, the wrap 202 can then be relaxed such that it contracts from the stretched position into a contracted position around the support 204, with the upper opening 206*a* above substantially the center of the support 204. As shown in the bottom view of FIG. 10D, in some embodiments the wrap 202 can extend at least partially underneath the support 204**.

Figure 9C:
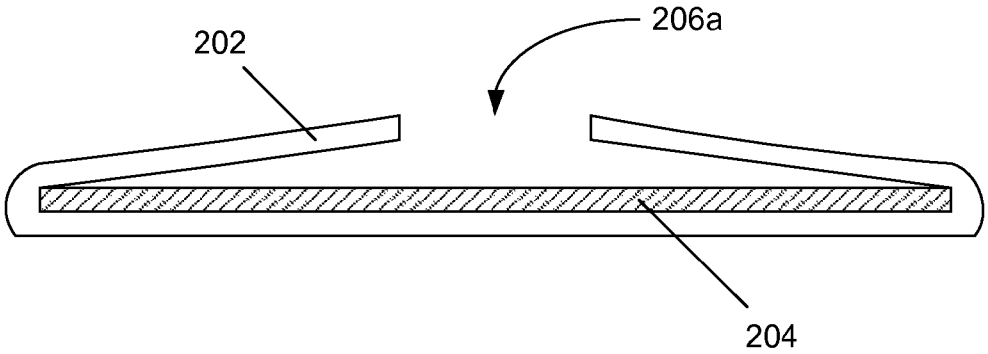
FIG. 9C depicts an exemplary embodiment of a stabilizer in which a wrap entirely covers the lower surface of a support.
Figure 11A:
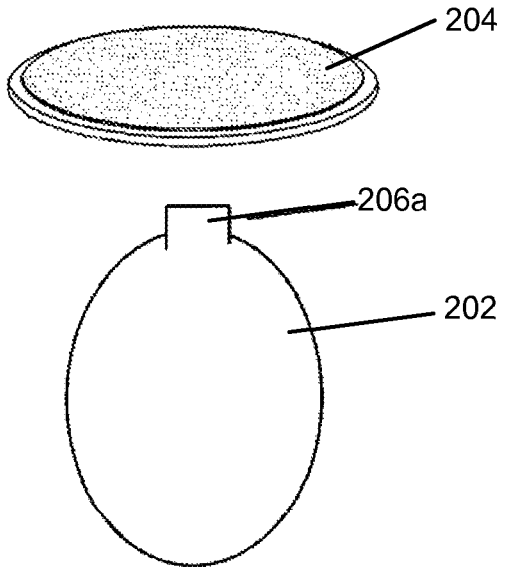
FIGS. 11A-11C depict exemplary steps for assembling another embodiment of a stabilizer.
Figure 11B:
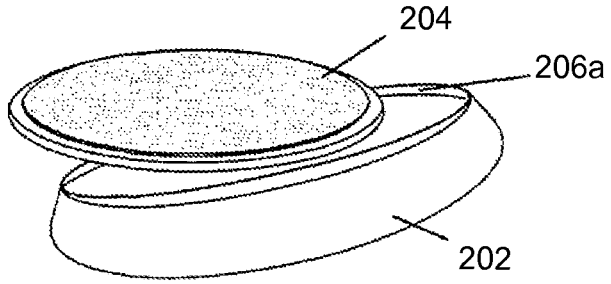
Figure 11C:
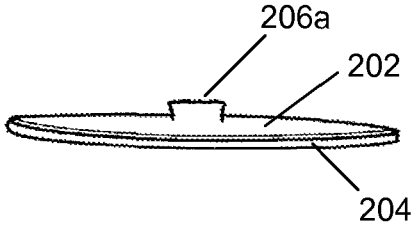

As discussed above, in alternate embodiments the wrap 202 can have a closed bottom. In embodiments in which the wrap 202 has a closed bottom, the support 204 can be held within the interior of the wrap 202 such that the bottom surface of the support 204 can be entirely covered by the wrap 202, as shown in FIG. 9C. FIGS. 11A-11C depict assembly of an embodiment of the stabilizer 200 with a stretchable wrap 202 having a closed bottom. As seen in FIG. 11A, the support 204 can be wider than the wrap 202. As seen in FIG. 11B, the wrap 202 can be stretched such that the support 204 can be inserted into the wrap 202 through the stretched upper opening **206*a*. As seen in FIG. 11C, the wrap 202 can then be relaxed such that it contracts from the stretched position into a contracted position around the support 204, with the upper opening 206*a* above substantially the center of the support 204**.

Figure 12A:
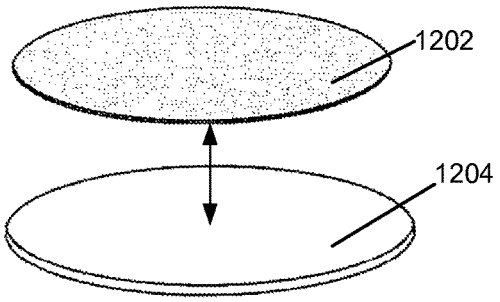
FIGS. 12A-12B depict a first exemplary embodiment of a support.
Figure 12B:
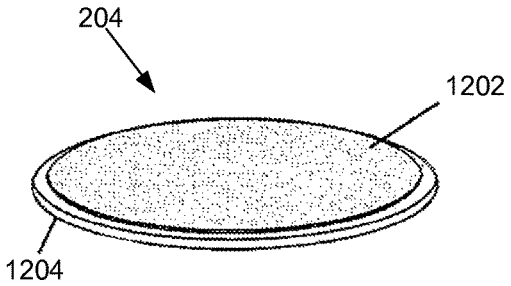

FIGS. 12A-12B depict a first exemplary embodiment of a support 204. In this embodiment, the support 204 can comprise a pad 1202 and a plate 1204, as shown in FIG. 12A. In some embodiments the pad 1202 can be a substantially planar member comprising cushioned material. The cushioned material can provide padding and/or shock absorption to a water pipe 100 that is inserted into the stabilizer 200. By way of non-limiting examples, the pad 1202 can comprise neoprene, rubber, gel, air pockets, foam, and/or any other type of padding. In alternate embodiments, the pad 1202 can comprise rigid or semi-rigid material, such as metal, wood, plastic, or any other material or combination of materials.

The plate 1204 can be a substantially planar member. In some embodiments the pad 1202 and plate 1204 can have substantially the same shape, while in other embodiments the pad 1202 and plate 1204 can have different shapes. In some embodiments, the plate 1204 can have raised or extruded perimeter edges, such that a recess is formed at the center of the plate 1204. In these embodiments, the pad 1202 can have smaller dimensions than the plate 1204, such that the pad 1202 can fit into the recess in the plate 1204. In other embodiments, the pad 1202 and plate 1204 can have the same or similar dimensions, as shown in FIG. 12B.

In some embodiments, the plate 1204 can comprise a material that is more rigid than that of the pad 1202, although the plate 1204 can itself have some flexibility in some embodiments. By way of non-limiting examples, the plate 1204 can comprise a plastic polymer, such as acrylic or high density polyethylene. In other embodiments, the plate 1204 can comprise metal, glass, wood, or any other desired material. In alternate embodiments, the plate 1204 can be formed of the same material as the pad 1202, or the plate 1204 can be less rigid than the pad 1202.

The pad 1202 can be positioned on a surface of the plate 1204, as shown in FIG. 12B. In some embodiments, the pad 1202 can be secured to the surface of the plate 1204 using adhesives, clips, friction fit, and/or any other connection mechanism. In other embodiments, the pad 1202 can be separate from the plate 1204 and can be positioned above the plate 1204 during use. In still other embodiments, the pad 1202 can be fit around the plate 1204 such that it covers one side of the plate 1204 and extends around the edges of the plate 1204 at least partially over the opposing side of the plate 1204.

Although the embodiment shown in FIGS. 12A-12B has a single pad 1202, in other embodiments the support 204 can have a plurality of pads 1202. By way of a non-limiting example, the support 204 can have separate pads 1202 positioned above and below the plate 1204, have multiple pads 1202 stacked on top of each other, or have pads 1202 that fill cut-outs, apertures, or other openings in the plate 1204. In still other embodiments, the pads 1202 can be absent and the support 204 can comprise the plate 1204 alone.

Figure 13:
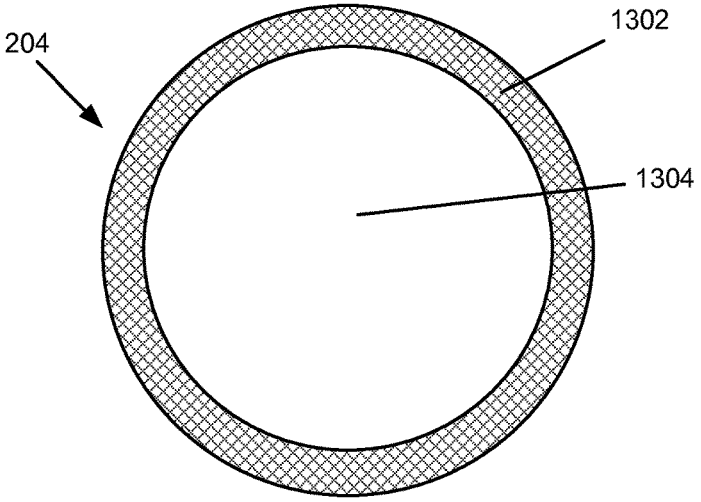
FIG. 13 depicts a second exemplary embodiment of a support.

FIG. 13 depicts a top view of a second exemplary embodiment of a support 204. In this embodiment, the support 204 can comprise an annular ring 1302 defining a center opening 1304. In this embodiment, the annular ring 1302 can push out the sides of the wrap 202 to provide a rigid or semi-rigid structure to a portion of the wrap 202. In embodiments in which the wrap 202 has a upper opening 206*a* and a lower opening 206*b*, the edges of the lower opening 206*b* can be coupled with the annular ring 1302, such that the floor 112 of a base chamber 102 can fit into and through the center opening 1304 of the annular ring, and also through the lower opening 206*b*. In embodiments in which the wrap 202 has a closed bottom, the bottom of the wrap 202 can act as part of the support 204, in that the floor 112 of a base chamber 102 can fit into and through the center opening 1304 of the annular ring 1302 such that the floor 112 rests directly against the bottom of the wrap 202 when a wrap 202 is secured around the base chamber 102. In alternate embodiments, a second annular ring 1302 can be coupled with the underside of the wrap 202, such that the second annular ring 1302 is configured to rest on a surface and the bottom of the wrap 202 is suspended above the surface.

Figure 14A:
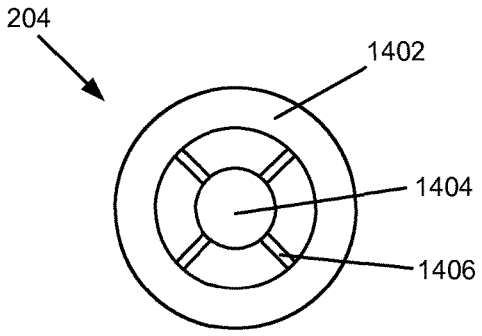
FIG. 14A depicts a third exemplary embodiment of a support.
Figure 14B:
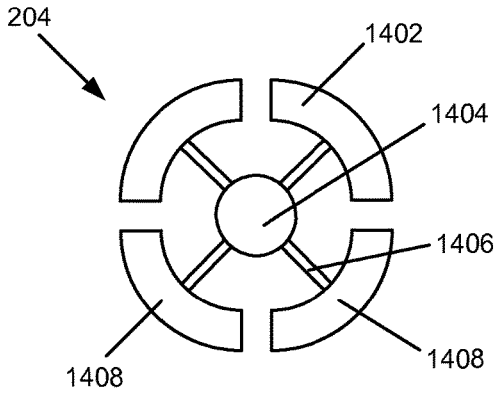
FIG. 14B depicts a fourth exemplary embodiment of a support.

FIGS. 14A-14B depict third and fourth exemplary embodiments of a support 204. In these embodiments, the support 204 can comprise an exterior ring 1402 connected to a central pedestal 1404 with extensions 1406. In some embodiments, the central pedestal 1404 can comprise rigid, semi-rigid, and/or cushioned components similar to the pad 1202 and/or plate 1204. In some embodiments, the exterior ring 1402 can have a fixed diameter width, as shown in FIG. 14A. In other embodiments, the exterior ring 1402 can comprise a plurality of arc sections 1408 each connected to a different extension 1406, and the extensions 1406 can be adjusted and locked into a new position to move the plurality of arc sections 1408 apart and away from the central pedestal 1404, or closer together and closer to the central pedestal 1404, to change the diameter of the exterior ring 1402, as shown in FIG. 14B.

In various embodiments, the wrap 202 and/or support 204 can have one or more additional features or attachments. By way of a non-limiting example, in some embodiments the stabilizer 200 can have one or more pockets or compartments for storage of items such as lighters, smokable substances, or any other items. By way of other non-limiting examples, some embodiments of the stabilizer 200 can have LED lights, glow-in-the-dark elements, speakers for music or other sounds, and/or batteries. In some embodiments, the exterior of the stabilizer 200 can have colors, designs, artwork, or any other decorative elements. In some embodiments the wrap 202 can be solid, however in other embodiments the wrap 202 can have cut-out patterns or designs.

Figure 15A:
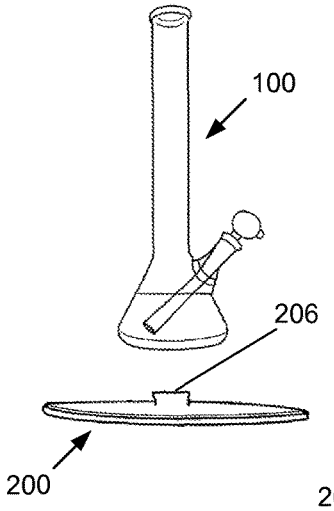
FIGS. 15A-15C depict steps for inserting a water pipe into an embodiment of a stabilizer.
Figure 15B:
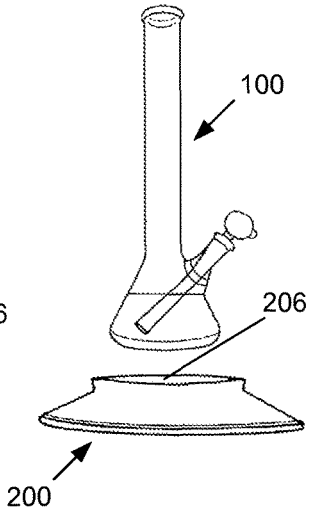
Figure 15C:
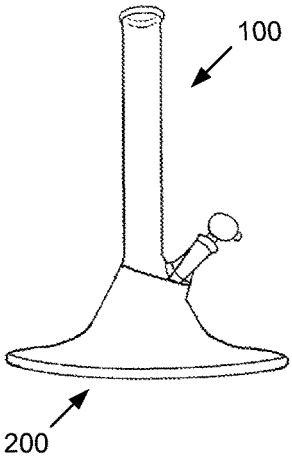
Figure 16:
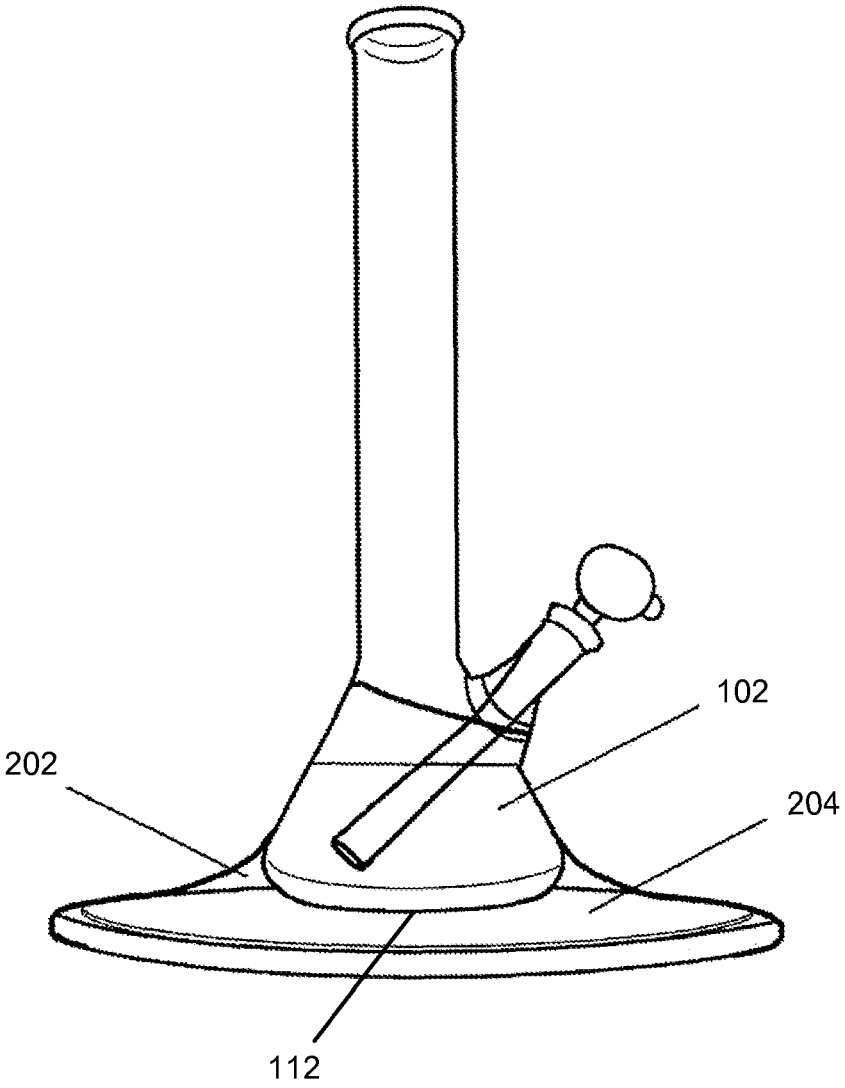
FIG. 16 depicts a water pipe visible inside an embodiment of a stabilizer secured around a portion of the water pipe.

In use, a user can install the stabilizer 200 on a water pipe 100 by securing the wrap 202 around a portion of the water pipe 100, such as around portions of the base chamber 102. In embodiments with a stretchable wrap 202, the opening 206 of the wrap 202 can be stretched to increase its diameter, as shown in FIGS. 15A-15B. The base chamber 102 of a water pipe 100 can be inserted through the opening 206 into the interior of the wrap 202. The wrap 202 can be stretched around the contours of the base chamber 102, such that the wrap 202 at least partially surrounds the base chamber 102, as shown in FIG. 15C. As discussed above, the wrap 202 can be stretched to fit around a variety of different sizes and shapes of water pipes 100 and base chambers 102 to accommodate different embodiments of water pipes 100. The floor 112 of the base chamber 102 can be placed against the support 204 and/or bottom of the wrap 202. Once the wrap 202 has been stretched around the base chamber 102, the material of the wrap 202 can be relaxed from its stretched state such that it tends toward its contracted state, thereby holding the base chamber 102 within the wrap 202 and against the support 204, as shown in FIGS. 15C and 16. By way of a non-limiting example, a wrap 202 made of a stretchable material such as latex or silicone can be stretched and molded around portions of the base chamber 102 such that the wrap 202 clings to the base chamber 102 and provides substantially even inward pressure against the base chamber 102 to hold it inside the stabilizer 200 and against the support 204.

In some embodiments, the material of the wrap 202 can interact with the material of the water pipe 100 to further secure the stabilizer 200 around the water pipe 100. By way of a non-limiting example, when the wrap 202 comprises a stretchable and at least partially sticky or clingy material such as latex or silicone and the water pipe is made of glass, the wrap's material can at least partially stick to the water pipe's glass to further secure the stabilizer around the water pipe 100.

In embodiments in which the wrap 202 is flexible and can be secured around the base chamber 102 using connectors 300, as shown in FIGS. 3A-3B, the wrap 202 can be folded, wrapped, and/or grouped around portions of the water pipe 100 and secured using appropriate connectors 300, with the floor 112 of the base chamber 102 placed against the support 204 and/or bottom of the wrap 202. As discussed above, the wrap 202 can be folded, wrapped, and/or grouped to fit around a variety of different sizes and shapes of base chambers 102 to accommodate different embodiments of water pipes 100, and different connectors 300 of the same wrap 202 can be chosen and used to secure the wrap 202 around different types of water pipes 100.

In embodiments in which the wrap 202 is a net, as shown in FIG. 4, the netting can be folded, wrapped, and/or grouped around portions of the water pipe 100, with the floor 112 of the base chamber 102 placed against the support 204 and/or bottom of the wrap 202. The net can be secured in place around the base chamber 102 by tightening and tying the drawstrings 400, or in other embodiments by allowing elastomeric cords to contract around the base chamber 102. As discussed above, the wrap 202 can be folded, wrapped, and/or grouped to fit around a variety of different sizes and shapes of base chambers 102 to accommodate different embodiments of water pipes 100.

In embodiments in which the wrap 202 is a cage, as shown in FIG. 5, the arms 500 can be secured around portions of the water pipe 100 to hold the floor 112 of the base chamber 102 against the support 204 and/or bottom of the wrap 202. As discussed above, in some embodiments the arms 500 can be bent or shaped such that they can fit around a variety of different sizes and shapes of base chambers 102 to accommodate different embodiments of water pipes 100. In some embodiments, the arms 500 can be locked in place after they are placed around the water pipe 100, while in other embodiments the arms 500 can be at least partially flexible but apply inward pressure to keep the water pipe 100 in place.

As described above, in some embodiments the wrap 202 can be stretchable, flexible, moldable, and/or otherwise malleable such that the same stabilizer 200 can fit around a variety of different shapes and sizes of water pipes 100. However, in other embodiments the stabilizer 200 can be custom manufactured to fit a particular water pipe 100 or a particular style or class of water pipe 100.

In some embodiments, a single stabilizer 200 can be installed on a water pipe 100. In other embodiments, multiple stabilizers 200 can be installed on a water pipe 100 by installing a first stabilizer 200 around the water pipe 100 and then installing a second stabilizer 200 by securing the second stabilizer's wrap 202 and support 204 around the first stabilizer 200.

As discussed above, in some embodiments the support 204 can be wider than the floor 112 of a water pipe's base chamber 102. By way of a non-limiting example, FIG. 16 depicts a water pipe 100 viewable within an attached stabilizer 200, and shows that the support 204 can be wider than the floor 112 of the base chamber 102. The support 204 can thus act as an extension of the floor 112 when the support 204 it is secured to the water pipe 100 with the wrap 202, and can thereby give the water pipe 100 a wider and more stable base than its floor 112 alone.

After the stabilizer 200 has been secured around the water pipe 100 as described above, it can provide stability and/or protection to the water pipe 100. In some embodiments, the weight of the material within the support 204 can help stabilize an attached water pipe 100 because its weight is dispersed over a wider area than the floor 112. In other embodiments, the support 204 can comprise weights or weighted sections that are heavier than other portions of the support 204 to provide additional stabilization. By way of a non-limiting example, in some embodiments weights can be coupled with a plate 1204 around the circumference of the plate 1204. By way of another non-limiting example, an exterior ring 1402 can be heavier than a central pedestal 1404.

Figure 17:
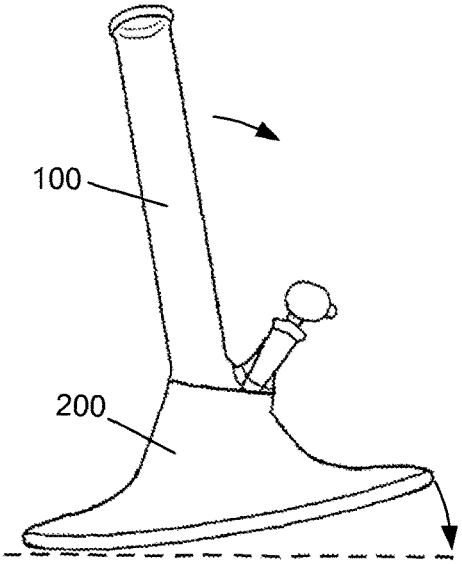
FIGS. 17-19 depict various manners of stabilizing and correcting water pipes into proper standing orientations by stabilizer embodiments.

FIG. 17 shows that if a water pipe 100 secured within a stabilizer 200 is placed down on a surface at an angle, or if the water pipe 100 begins to tip or is in the process of tipping, the side of the support 204 opposite to the direction in which the water pipe 100 would tend to fall can act as a counterweight and pull the water pipe 100 back into its proper standing orientation. Similarly, if a water pipe 100 secured within a stabilizer 200 is placed down on a surface that is uneven or is not completely level, the stabilizer 200 can provide a base such that the water pipe 100 can be kept standing at least partially upright on the uneven surface without tipping. FIG. 17 also shows that the wrap 202, being pulled down by the weight of the support 204 on the side opposite to the side to which the water pipe 100 is falling, can also pull down the base chamber 102 on that side within the wrap 202 to correct the water pipe's orientation.

Figure 18:
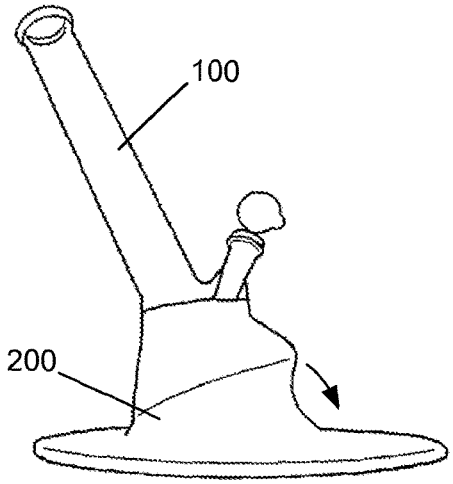

FIG. 18 shows that if the floor 112 of a water pipe 100 is partially knocked away from the support 204 while the wrap 202 is secured around the water pipe 100, the elasticity or presence of the wrap 202 can hold in and/or pull down the base chamber 102 against the support 204 to correct the water pipe's orientation.

Figure 19:
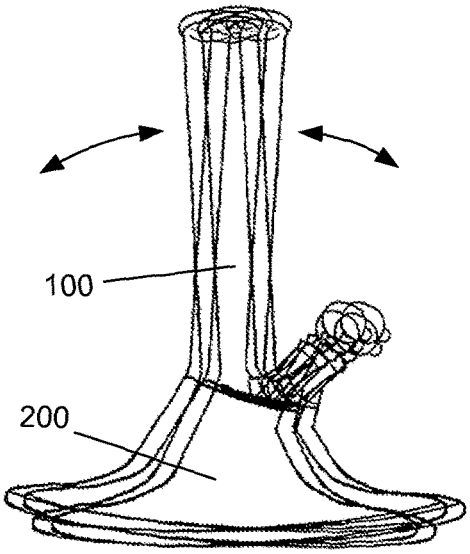

FIG. 19 shows that if the water pipe 100 and/or stabilizer 200 wobbles, such as when the water pipe 100 is set down, when the stabilizer 200 is correcting the water pipe's orientation, or when the stabilizer 200 is otherwise stabilizing the water pipe 100 or correcting or preventing a tip, the weight and/or width of the support 204 can counteract the wobbling and stabilize the water pipe 100 into its proper standing orientation. Additionally, in some embodiments in which the support 204 is circular, when the water pipe 100 wobbles the stabilizer 200 and attached water pipe 100 can spin along the edge of the support 204 by rolling along a small portion of the support's edge that contacts the surface below. In this example, centripetal force toward the center of the axis of rotation can tend to return the water pipe 100 to a centered and balanced standing position.

The texture of the support 204, such as the pad 1202 and/or plate 1204, and/or the bottom of the wrap 202 can provide a gripping surface that can help prevent movement of the water pipe's floor 112 through friction with the gripping surface. In some embodiments the support 204 and/or bottom of the wrap 202 can further absorb shocks caused when the stabilizer 200 and/or water pipe 100 impacts other surfaces and/or when the stabilizer 200 is correcting a tip. Additionally, in some embodiments in which the support 204 and/or bottom of the wrap 202 comprises padding or cushioning, such as embodiments with a pad 1202 that is rubberized or elastomeric, the inherent upward forces provided by the padding or cushioning can tend to counteract any imbalanced downward forces from the base chamber 102. By way of a non-limiting example, if the water pipe 100 begins to tip such the one side of the floor 112 is lower than the other side and is pressing into the padding, the padding can resist being compressed and push up on the lower side of the floor 112 to help correct the water pipe 100 back into its proper standing orientation and help prevent tipping. In some alternate embodiments in which the wrap 204 has a closed bottom and the support is an annular ring 1302, such that the floor 112 of a water pipe 100 can rest on the bottom of the wrap 202 through the center opening 1304, the bottom of the wrap 202 can serve as a substantially taut trampoline to provide stabilizing and/or shock absorption features to the stabilizer 200.

Additionally, in embodiments in which the stabilizer 200 has cushioning, such as embodiments with a pad 1202 in the support 204, embodiments with padding in the wrap 202 such as those shown in FIG. 7, and/or embodiments in which the wrap 202 inherently provides some level of cushioning to a water pipe 100 inserted into the stabilizer 200, the cushioning can absorb shock from impacts that would otherwise be transferred to the water pipe 100. By way of a non-limiting example, if the water pipe 100 is impacted in a manner that might otherwise lead to damage or breakage of the water pipe 100, such as the water pipe 100 being forcefully placed on a table or being fully tipped over, the cushioning of the stabilizer 200 can absorb some of the impact force such that the chance of damaging the water pipe 100 is lessened. As another non-limiting example, when the wrap 202 is made of an elastic material such as latex or silicone, the cushioning inherently provided by the elasticity of the wrap 202 can assist in absorbing shocks and/or protecting the water pipe 100 when the stabilizer 200 is correcting a tip or when a tip occurs.

The stabilizer 200 can be installed on a water pipe 100 such that normal operation of the water pipe 100 is not inhibited. By way of a non-limiting example, the water pipe 100 can be picked up, used, and placed back down on a surface with the stabilizer 200 attached to the water pipe 100, as the bowl 106, carburetor 110, and mouth opening 114 can be left uncovered by the stabilizer 200. After installation, the stabilizer 200 can be left on the water pipe 100, or be removed or replaced with a different stabilizer 200 at any desired time.

While the stabilizer 200 has been described above in use with water pipes 100, the stabilizer 200 can alternately be used with other items that a user desires to stabilize and/or protect. By way of non-limiting examples, the wrap 202 of the stabilizer 200 can be attached around the lower portions of hookahs, handheld pipes, bubbler pipes, deodorant sticks, hand-blown or manufactured glass pieces, flower vases, lab beakers, drinking glasses, wine glasses, water bottles, sign posts, table legs, or any other desired item to stabilize and/or protect the attached item. The stabilizer 200 can also be used to place items in a vertical position that do not ordinarily stand on end. By way of a non-limiting example, the stabilizer 200 can be coupled with an end of a vaporizer pen such that the stabilizer 200 can be placed on a surface to orient the vaporizer pen vertically when not in use.

Although the invention has been described in conjunction with specific embodiments thereof, it is evident that many alternatives, modifications and variations will be apparent to those skilled in the art. Accordingly, the invention as described and hereinafter claimed is intended to embrace all such alternatives, modifications and variations that fall within the spirit and broad scope of the appended claims.

What is claimed is:

1. A stabilizer comprising:

a wrap defining an opening, said wrap being flexible and elastomeric, and a support housed within said wrap, said support comprising an at least semi-rigid planar member that is wider than said wrap when said wrap is in a relaxed state, such that said support deforms said wrap when said support is inside said wrap to expand around the dimensions of said support, wherein said opening is positioned above the center of said support, wherein said opening is configured to stretch to allow a portion of an inserted item to fit through said opening into said wrap, wherein said wrap is configured to stretch around said portion of said inserted item and contract to hold said portion of said inserted item within said wrap and against said support and, wherein said support has a greater diameter than the diameter of the base of said inserted item.

2. The stabilizer of claim 1, wherein said wrap comprises material that is at least partially clingy against said inserted item.

3. The stabilizer of claim 2, wherein said material is selected from the group consisting of latex and silicone.

4. The stabilizer of claim 1, wherein said support comprises a plate and a pad coupled with an upper surface of said plate.

5. The stabilizer of claim 1, wherein said support comprises an annular ring.

6. The stabilizer of claim 1, wherein said support comprises an exterior ring coupled with a central pedestal via a plurality of extensions.

7. The stabilizer of claim 6, wherein said exterior ring comprises a plurality of arc segments each coupled with a different one of said plurality of extensions, and said plurality of extensions are configured to be extended or retracted from said central pedestal to adjust the width of said support.

8. The stabilizer of claim 1, wherein said wrap comprises textured components on an interior surface.

9. The stabilizer of claim 1, wherein said wrap comprises a plurality of padded pockets.

10. The stabilizer of claim 1, wherein said wrap comprises a plurality of ribs.

11. The stabilizer of claim 1, wherein said wrap further comprises a second opening positioned below said support.

12. The stabilizer of claim 11, wherein edges of said second opening are stretched around and at least partially beneath said support.

* * * * *